United States Patent [19]

Dykstra

[11] Patent Number: 4,977,877

[45] Date of Patent: Dec. 18, 1990

[54] SPEED LIMITER FOR INTERNAL COMBUSTION ENGINES

[75] Inventor: Richard A. Dykstra, Cedar Grove, Wis.

[73] Assignee: Briggs & Stratton Corporation, Wauwatosa, Wis.

[21] Appl. No.: 454,378

[22] Filed: Dec. 21, 1989

[51] Int. Cl.[5] ..... F02P 9/00

[52] U.S. Cl. ..... 123/335; 123/198 D

[58] Field of Search ..... 123/198 D, 335

[56] References Cited

U.S. PATENT DOCUMENTS

| | | | |
|---|---|---|---|
| 3,276,439 | 10/1966 | Reichenbach | 123/376 |
| 3,563,219 | 7/1968 | Mieras | 123/335 |
| 3,581,720 | 11/1968 | Hemphill | 123/335 |
| 3,601,103 | 10/1969 | Swiden | 123/335 |
| 3,665,903 | 5/1972 | Harris et al. | 123/335 |
| 3,884,203 | 5/1975 | Cliffgard | 123/335 |
| 4,023,550 | 5/1977 | Houston | 123/198 D |
| 4,034,732 | 7/1977 | Van Burkleo | 123/198 DC |
| 4,058,094 | 11/1977 | Moore | 123/356 |
| 4,074,665 | 2/1978 | Patis | 123/335 |
| 4,237,997 | 12/1980 | Swanson | 123/335 |
| 4,252,096 | 2/1981 | Kennedy | 123/370 |
| 4,292,939 | 10/1981 | Coates et al. | 123/198 D |
| 4,307,690 | 12/1981 | Rau et al. | 123/353 |
| 4,336,778 | 6/1982 | Howard | 123/198 D |
| 4,404,940 | 9/1983 | Sieja | 123/335 |
| 4,462,356 | 7/1984 | Hirt | 123/335 |
| 4,491,105 | 1/1985 | Johansson | 123/335 |
| 4,531,489 | 7/1985 | Sturdy | 123/376 |
| 4,532,901 | 8/1985 | Sturdy | 123/333 |
| 4,641,618 | 2/1987 | Dogadko et al. | 123/198 D |
| 4,664,080 | 5/1987 | Minks | 123/335 |
| 4,712,521 | 12/1987 | Campen | 123/198 D |
| 4,875,448 | 10/1989 | Dykstra | 123/352 |
| 4,884,541 | 12/1989 | Marriott | 123/361 |

FOREIGN PATENT DOCUMENTS

| | | | |
|---|---|---|---|
| 0063368 | 4/1984 | Japan | 123/335 |
| 0229027 | 12/1984 | Japan | 123/198 D |

*Primary Examiner*—Tony M. Argenbright
*Assistant Examiner*—Robert E. Mates
*Attorney, Agent, or Firm*—Andrus, Sceales, Starke & Sawall

[57] ABSTRACT

An engine speed limiter is disclosed in which the ignition primary winding is shorted to limit engine speed whenever an ignition pulse is received by a switch at the same time that a switch is gated on by a positive output pulse from a timing circuit. A signal conditioning circuit receives a positive-going pulse from the ignition primary winding and outputs a conditioned signal to the timer to begin the timer's positive output signal. The speed limiter is suitable to be retrofit onto existing ignition systems.

9 Claims, 2 Drawing Sheets

SPEED LIMITER FOR INTERNAL COMBUSTION ENGINES

BACKGROUND OF THE INVENTION

The present invention relates to speed limiters for internal combustion engines, and more particularly to speed limiters for small internal combustion engines of the type used to power lawnmowers, snowblowers, generators and the like.

Conventional ignition apparatus for internal combustion engines comprises a primary and a secondary winding that are inductively coupled with one another, a spark plug connected across the terminals of the secondary winding, and control switch means for closing a circuit to enable current to flow in the primary winding and for opening that circuit at a time when the spark plug is to be fired. In battery ignition systems, the closing of the circuit that includes the control switch means allows battery current to flow in the primary winding. In a magneto ignition system, an electromagnetic field is induced in the primary winding by an orbitally moving magnet in cooperation with a fixed ferromagnetic core around which the primary and secondary windings are wound. The closing of the control switch means short-circuits the primary to allow current flow in it.

In either case, opening the primary circuit brings an abrupt change in a flux field with the secondary winding, thereby inducing a high voltage across the secondary and causing the spark plug to fire.

The conventional control switch means typically includes a pair of hard metal breaker points that are actuated by a mechanism having a cam that rotates in timed relation to the engine's cycle. More recently, the control switch means includes a semiconductor device such as a transistor, and a simple means for turning on and off the semiconductor device in timed relation to the engine's cycle.

It is often desirable to limit the speed of an engine to a predetermined maximum speed. Several types of electronic speed limiters are known. One type operates off the engine's alternator. Since the alternator typically provides a voltage proportional to the engine's speed, controlling the maximum voltage that may be reached by the alternator then controls the engine's maximum speed.

Electronic speed limiters are also known which are an integral part of the engine ignition system. Such speed limiters have the disadvantage that they cannot be easily retrofit onto an existing engine's ignition system without replacing at least a portion of the ignition system. Therefore, it is desirable to provide a simple engine speed limiter which may be retrofit onto an existing engine by connecting it to the engine's ignition system.

SUMMARY OF THE INVENTION

A speed limiter for internal combustion engines is disclosed which is inexpensive and which may be easily retrofit onto an existing internal combustion engine. The speed limiter is used with engines having an ignition primary winding that includes a first terminal which outputs an ignition pulse. The primary winding is inductively coupled to a secondary winding to which a spark plug is connected.

The speed limiter includes signal conditioning means for receiving a winding signal from the primary winding and for outputting a conditioned signal, a timing means for receiving the conditioned signal and for outputting an output signal with a specific time period, and a first switch means connected in circuit to the first terminal of the primary winding and to the timer means for activation in response to the timer means output pulse to short the ignition pulse received from the first terminal, thereby preventing the spark plug from firing.

In a preferred embodiment, the signal conditioning means receives a high-state voltage winding signal from the primary winding and outputs a low-state voltage conditioned signal to the timing means. When this occurs, the timer output goes to a high state for a specific period of time. The switch means is activated by being turned on to short the ignition primary in response to the output signal when the output signal is in its high state and when at the same time the negative-going ignition pulse is occurring.

The timer means is preferably a monolithic integrated circuit 555 timer, and the first switch means is preferably a triac. The time period during which the output signal is in its high state is preferably determined by the desired maximum engine speed.

It is a feature and advantage of the present invention to provide a simple and inexpensive engine speed limiter which may be retrofit onto an internal combustion engine.

It is another feature and advantage of the present invention to provide a precise electronic speed limiter that uses standard, off-the-shelf components.

These and other features and advantage of the present invention will be apparent to those skilled in the art from the following detailed description of a preferred embodiment and the attached drawing in which:

DETAILED DESCRIPION OF THE PREFERRED EMBODIMENT

Figure 1A:
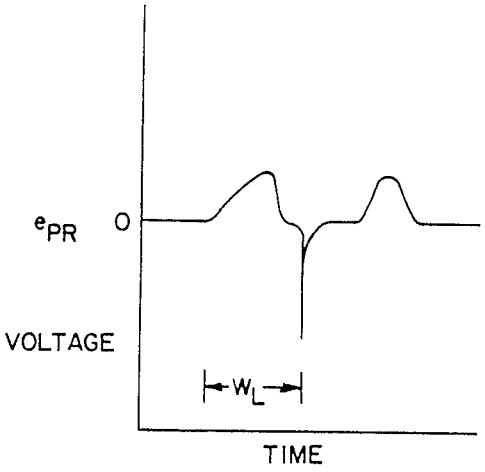
FIG. 1A is a graph depicting the ignition primary winding voltage pulses when the engine is operating at a relatively low speed.
Figure 1B:
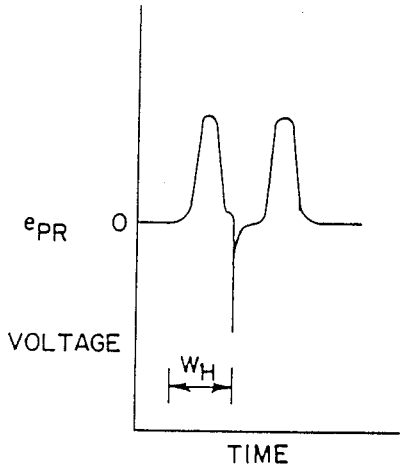
FIG. 1B is a graph depicting the ignition primary winding voltage pulses when the engine is operating at a relatively high speed.

FIGS. 1A and 1B are graphs which depict the operating principle of the present invention. FIG. 1A includes two positive-going pulses from the ignition primary winding. The positive-going pulses are relatively long in duration because the engine is running at a relatively low speed. The negative pulse depicted in FIG. 1A corresponds to the ignition pulse which is generated to fire the spark plug. The time duration from the start of the positive-going voltage pulse to the ignition pulse is shown as $W_L$.

FIG. 1B is a graph depicting the primary winding voltage pulses when the engine is running at a relatively high speed. As can be seen by comparing FIGS. 1A and 1B, the time duration from the start of the positive-going pulse to the ignition pulse in FIG. 1B, which is shown as $W_H$, is less than the time duration of $W_L$, shown in FIG. 1A. The time duration from the start of the positive-going pulse to the ignition pulse is used as an indicator of engine speed since it is functionally related to engine speed. The frequency of ignition pulses increases when the engine runs at a higher speed, as shown in FIG. 1B, since one ignition pulse is generated during each engine flywheel revolution.

The positive-going primary winding pulse is used in the present invention to trigger a one-shot timer means 10 (FIG. 2) having a fixed output pulse width in its high state. The timer means generates an output signal which has both a high state and a low state. When the output signal is in its high state, it gates on a first switch means to short the ignition primary winding, thereby preventing a sufficient negative voltage from being achieved across the primary winding to enable the spark plug to be fired. Since the spark plug cannot fire, the engine speed is limited to a predetermined maximum speed.

Figure 2:
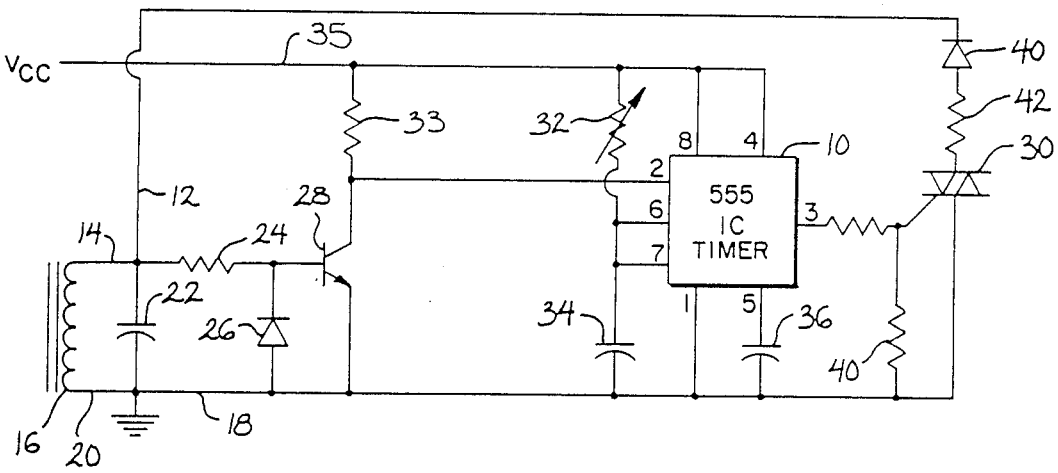
FIG. 2 is a schematic drawing of the preferred embodiment of the present invention.

FIG. 2 is a schematic drawing depicting the preferred embodiment of the speed limiter according to the present invention. In FIG. 2, line 12 is connected to a first terminal 14 of primary winding 16, and line 18 is connected to a second terminal 20 of primary winding 16. Primary winding 16 is inductively coupled to a secondary winding (not shown) across whose terminals is connected at least one spark plug (not shown). The winding signal received from primary winding 16 is conditioned by a signal conditioning means comprising a filter capacitor 22, a resistor 24, a diode 26, and a second switch means 28. Capacitor 22 limits the rate at which the winding signal from primary winding 16 rises to prevent abrupt changes in the winding signal from turning on the first switch means, here triac 30. Capacitor 22 may not be necessary if a switch with a sufficiently high dv/dt rating is used as first switch means 30. Diode 26 is used to protect second switch means 28 from reverse-polarity power dissipation. Second switch 28 is biased on by a positive winding signal primary winding 16.

The turning on of second switch 28 brings pin 2 of timer means 10 to a low voltage state, causing the output signal of timer 10 to go to a high state.

The width of the high state pulse output by timer 10 is fixed and is a function of: the desired limit speed of the engine; the length of time between the point at which the ignition pulse waveform goes positive to the point where the spark plug firing would otherwise occur; the flywheel diameter; and the position of the orbiting magnet. The desired high state pulse width is typically in the range of between 0.5 to 1.5 milliseconds. At low engine speeds, the timer output will return to a low state before the point at which spark plug firing is to occur, and there will be no effect on the engine's ignition system since engine speed is only limited when both the timer's output signal is in its high state at the same time that the ignition pulse is occurring.

The pulse width of the output signal of timer 10 is fixed by choosing appropriate values for resistor 32 and capacitor 34. Resistor 32 and capacitor 34 establish a voltage on pin 6 of timer 10 which determines the width of the timer's high state output signal. By changing either or both the values of resistor 32 and capacitor 34, the amount of time that the output of timer 10 remains in its high state is changed, thereby determining the engine limit speed.

Line 35 connects a positive DC voltage power supply (not shown) to power timer 10. The output of the power supply is typically between 5 and 10 volts, and typically can be supplied by the engine's magneto ignition coil primary winding, with appropriate signal conditioning. Capacitor 36 operates as a noise filter. Resistors 38 and 40 comprise a voltage divider which controls the magnitude of the voltage signal applied to the gate of the first switch means, triac 30.

Diode 40 blocks the positive-going cycles of the primary winding current to help limit power dissipation in triac 30. Resistor 42 is a low-value (typically between 10 to 15 ohms) resistor that is used to limit peak triac current.

The circuit depicted in FIG. 2 operates in the following manner. Positive-going winding signals from ignition primary 16 are conditioned by the signal conditioning means consisting of capacitor 22, resistor 24, resistor 33, diode 26, and switch 28. A low-state conditioned signal is output to pin 2 of timer 10 when the primary winding voltage signal goes positive. This causes timer 10 to begin generating an output signal having a high state. The high state output signal is output by timer 10 at pin 3 through resistor 38 and gates on triac 30 for a predetermined period of time as discussed above. If during the time that triac 30 is gated on, a negative-going ignition voltage signal is generated by ignition primary 16, that voltage signal is shorted since the first terminal 14 of primary 16 is connected to line 12, which in turn is connected through gated-on triac 30 to line 18 and to the second terminal 20 of primary 16. The shorting of the ignition primary reduces the voltage across the primary to a level which is insufficient to fire the engine's spark plug. The ignition pulses will be shorted only when the engine reaches the desired limit or maximum speed.

Various types of switches could be used in place of triac 30, including an SCR or a transistor, depending upon the type of ignition system and input signal conditioning being used. The present invention is particularly suitable for engines equipped with inductive magneto or capacitor-discharge ignition systems.

The speed limiter according to the present invention automatically resets itself after every engine flywheel revolution since primary winding current is not continuous. If the next engine flywheel revolution is not too fast, spark plug firing is not inhibited. Shorting of the ignition pulses only occurs when the limit speed is exceeded on any single engine flywheel revolution.

Figure 3:
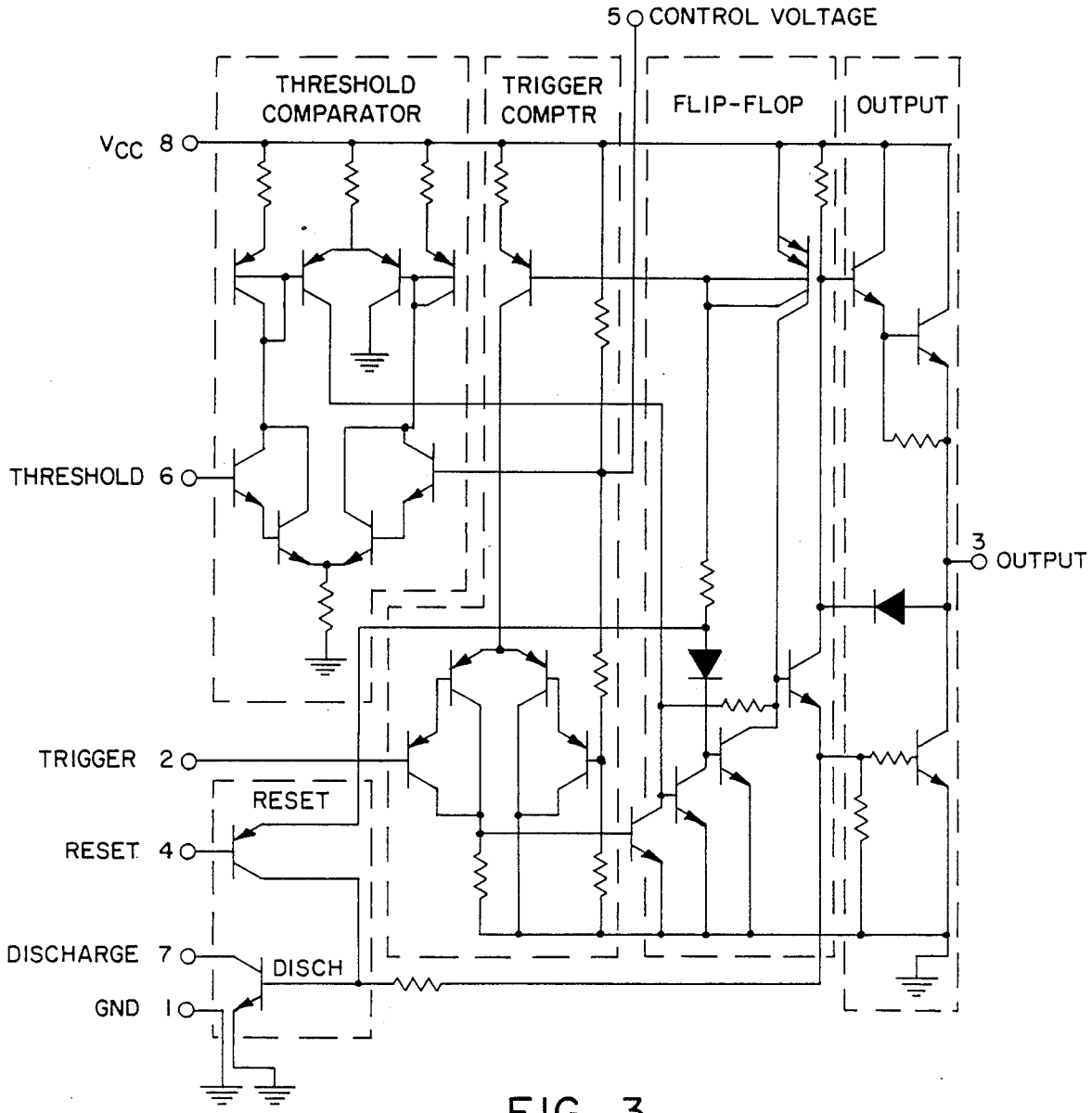
FIG. 3 is a schematic drawing of a typical IC 555 timer that is suitable for use in the preferred embodiment depicted in FIG. 2.

FIG. 3 is a schematic drawing of a typical timer that may be used as timer 10 in FIG. 2. The schematic depicted in FIG. 3 corresponds to a Motorola MC1555 monolithic timing circuit, although other 555 timing circuits could be used for timer 10.

Although a preferred embodiment of the present invention has been shown and described, other alternate embodiments will be apparent to those skilled in the art and are within the intended scope of the present invention. Therefore, the present invention is to be limited only by the following claims.

I claim:

1. A speed limiter for internal combustion engines, said engine having a magneto ignition system and an ignition primary winding that outputs an ignition pulse, said primary winding including a first terminal and being inductively coupled to a secondary winding to which a spark plug is connected, said speed limiter comprising:

signal conditioning means for receiving a winding signal from said primary winding and for outputting a conditioned signal;

timer means for receiving said conditioned signal and for outputting a single control signal per ignition cycle; and a first switch means, connected in circuit to said first terminal and to said timer means, for receiving said single control signal and for activating in response to said single control signal to short said ignition pulse thereby preventing said spark plug from firing.

2. The speed limiter of claim 1, wherein said signal conditioning means receives a high-state winding signal from said primary winding and outputs a low-state conditioned signal.

3. The speed limiter of claim 1, wherein said output signal has a low state and a high state, and wherein said first switch means is activated by turning on when said output signal is in its high state.

4. The speed limiter of claim 3, wherein said ignition pulse has a negative-going cycle, and wherein said switch means shorts the negative-going pulse when both said output signal is in its high state and when said ignition pulse is negative-going.

5. The speed limiter of claim 3, wherein the time period during which said output signal is in its high state is determined by the desired maximum engine speed.

6. The speed limiter of claim 1, further comprising:

a source of direct current that powers said timer means.

7. The speed limiter of claim 1, wherein said signal conditioning means includes:

a filter capacitor that limits the rate at which said winding signal rises; and a second switch means connected in circuit with said filter capacitor and said timer means that outputs said conditioned signal to said timer means.

8. The speed limiter of claim 1, wherein said timer means is a 555 timer circuit.

9. The speed limiter of claim 1, wherein said first switch means is a triac.

* * * * *